United States Patent [19]

Lozar

[11] 4,298,913

[45] Nov. 3, 1981

[54] ILLUMINATING APPARATUS

[76] Inventor: Michael J. Lozar, 835 W. Magnolia, Auburn, Ala. 36830

[21] Appl. No.: 96,537

[22] Filed: Nov. 21, 1979

[51] Int. Cl.[3] ..... F21L 15/08

[52] U.S. Cl. ..... 362/103; 362/105; 362/106; 362/108; 362/191; 362/396

[58] Field of Search ..... 362/103, 105, 106, 108, 362/191, 396

[56] References Cited

U.S. PATENT DOCUMENTS 2,524,881 10/1950 Chambers ..... 362/106 X 3,749,902 7/1973 Drew ..... 362/106

*Primary Examiner*—Stephen J. Lechert, Jr.

*Attorney, Agent, or Firm*—Newton, Hopkins & Ormsby

[57] ABSTRACT

A battery case retains a battery and is provided with a cable having a removable plug at its distal end, the plug being received in an externally threaded socket member which carries an electric bulb. The socket is threadedly received in a bulb housing of a lamp element member mounted on one side of a bifurcated clip which can be removably installed on a support plate or visor of a hardhat. The battery case has a belt clip which enables the case to be clipped to the belt of a person and rotatably mounting plate on the surface of the case so as selectively to receive the bifurcated clip of the lamp element, on the belt clip or on the plate whereby the lamp element may be rotated with respect to the battery case. In another embodiment, the clip of the lamp element is also removably receivable on a tilt plate carried by a bracket on a head band.

20 Claims, 5 Drawing Figures

FIG 2
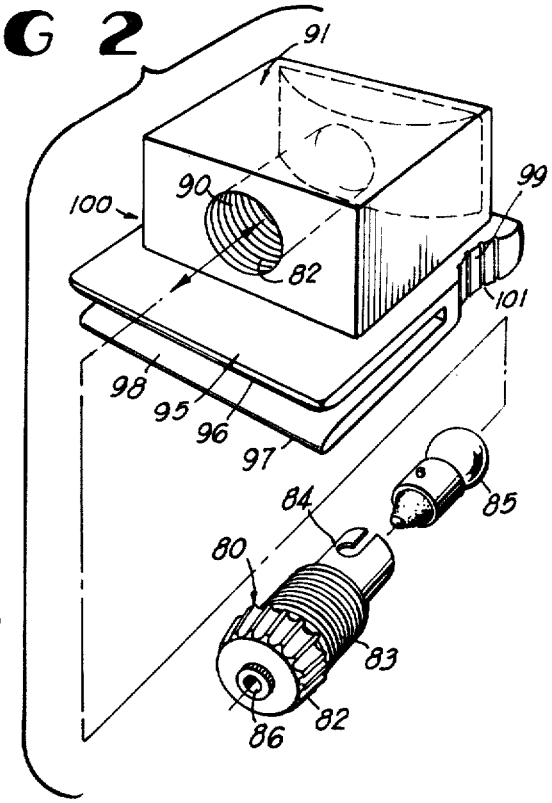
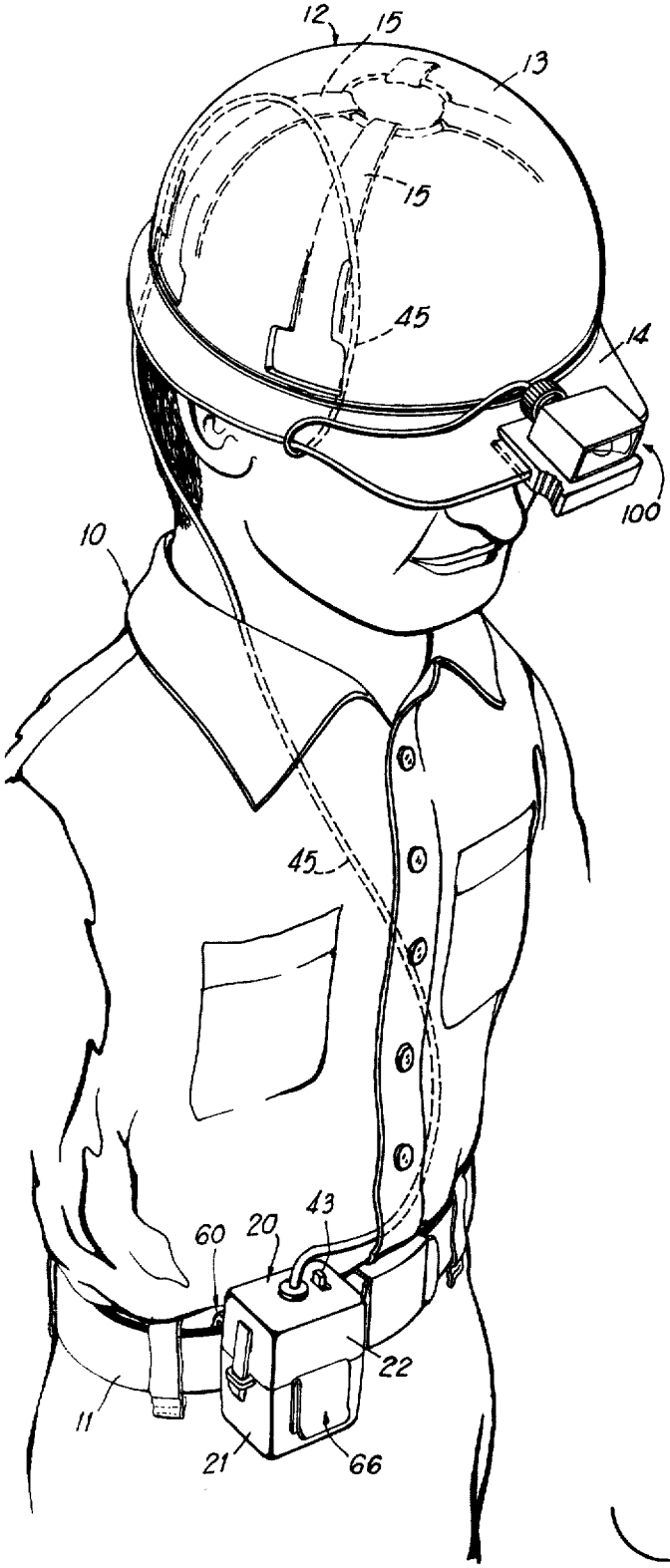
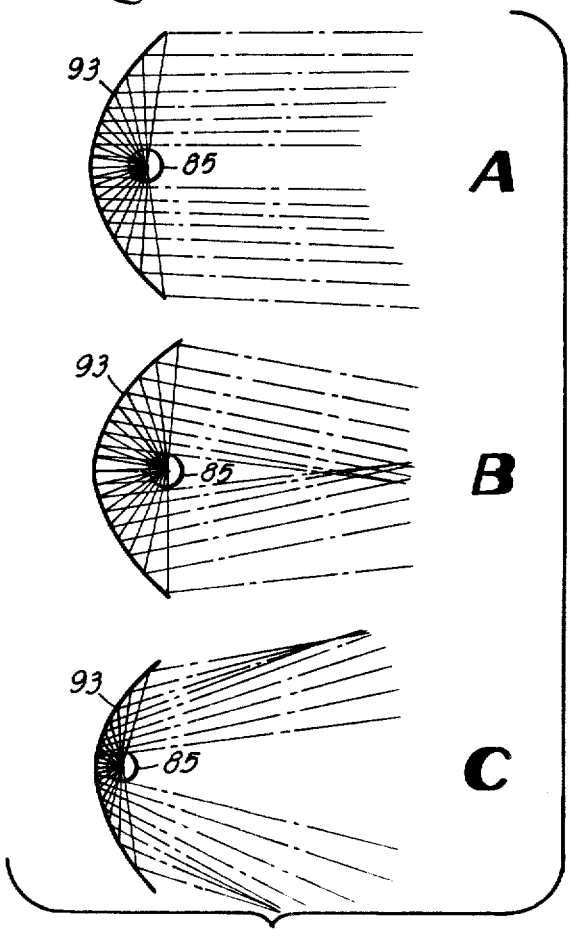
FIG 1
FIG 3

ILLUMINATING APPARATUS

BACKGROUND OF THE INVENTION

1. Field of the Invention

This invention relates to an illuminating apparatus and is more particularly concerned with a portable lamp assembly for mounting on the body of a person.

2. Description of the Prior Art

In the past, numerous portable lamps have been devised. For example, U.S. Pat. No. 3,953,725 discloses an illuminating apparatus which includes a rechargeable battery carried by a belt clip and a cable which extends from the battery to the housing of the lamp. The lamp is mounted by a clip connection on the dome part of the hardhat.

U.S. Pat. No. 1,757,887 discloses a miner's lamp which is also removably mounted on a hat with a battery assembly carried by the belt of the miner.

U.S. Pat. No. 1,406,025 discloses still another lamp which is mounted on the hat of a person and contains a battery carried by the belt of the person.

U.S. Pat. No. 2,524,881 discloses still another lamp mounted on the visor of a hat or cap.

SUMMARY OF THE INVENTION

Briefly described, the present invention includes a battery pack having a battery housing or case which removably contains a battery therein, the housing having a belt clip on one side and a pivotable clip or support plate on the other side. The belt clip enables the housing to be removably carried on the belt of a person. A cable leads from the housing and is provided at its distal end with a removable plug which plugs into a rear receptacle of a rotatable socket member, the distal end of the rotatable socket member carrying a removable bulb. The socket member is threadedly received in the bulb housing of a lamp element, the forward portion of the bulb housing being concave and provided with reflector through which the bulb projects. By manipulation of the socket member axially in the bulb housing the focusing of the bulb can be varied, as desired.

Mounted on the bulb housing of the lamp element is a bifurcated clip which is opened on the rear and sides so as to be removably received on the visor of a hardhat. This clip is also adapted to cooperate with the rotatable clip or plate of the battery housing so that the lamp element can be carried by the battery housing and directed in prescribed directions.

In a second embodiment of the invention, a hat band which is provided with a bracket carries a tiltable plate on which the clip of the lamp element is removably mounted.

Accordingly, it is an object of the present invention to provide an illuminating apparatus which is inexpensively manufactured, durable in structure, and efficient in operation.

Another object of the present invention is to provide an illuminating apparatus which may be removably mounted on the visor of a hardhat, without alteration to the hardhat.

Another object of the present invention is to provide an illuminating apparatus which may be readily and easily focused while in use.

Another object of the present invention is to provide an illuminating apparatus in which the power source is carried by the belt of a person and the illuminating portion thereof can be cut on and off adjacent to the belt.

Another object of the present invention is to provide an illuminating apparatus which has a cable which can be fed through the interior of a conventional hardhat when it is desired to use the apparatus on a hardhat.

Another object of the present invention is to provide an illuminating apparatus in which the lamp element can be readily and easily removed and installed on a conventional hardhat.

Another object of the present invention is to provide an illuminating element in which the lamp element can be selectively mounted at the waist of a person or on the hat or head band of a person.

Other objects, features and advantages of the present invention will become apparent from the following description when taken in conjunction with the accompanying drawings wherein like characters of reference designate corresponding parts throughout the several views.

BRIEF DESCRIPTION OF THE DRAWINGS

FIG. 1 is a prospective view of a person wearing a hardhat and having mounted on his body, an illuminating apparatus constructed in accordance with the present invention;

FIG. 2 is an exploded prospective view of the lamp element of the illuminating apparatus depicted in FIG. 1;

FIG. 3 is a schematic, horizontal sectional view of a portion of the lamp element of the illuminating apparatus of FIGS. 1 and 2 showing the focus of the lamp portion thereof;

DESCRIPTION OF THE PREFERRED EMBODIMENTS

Figure 4:
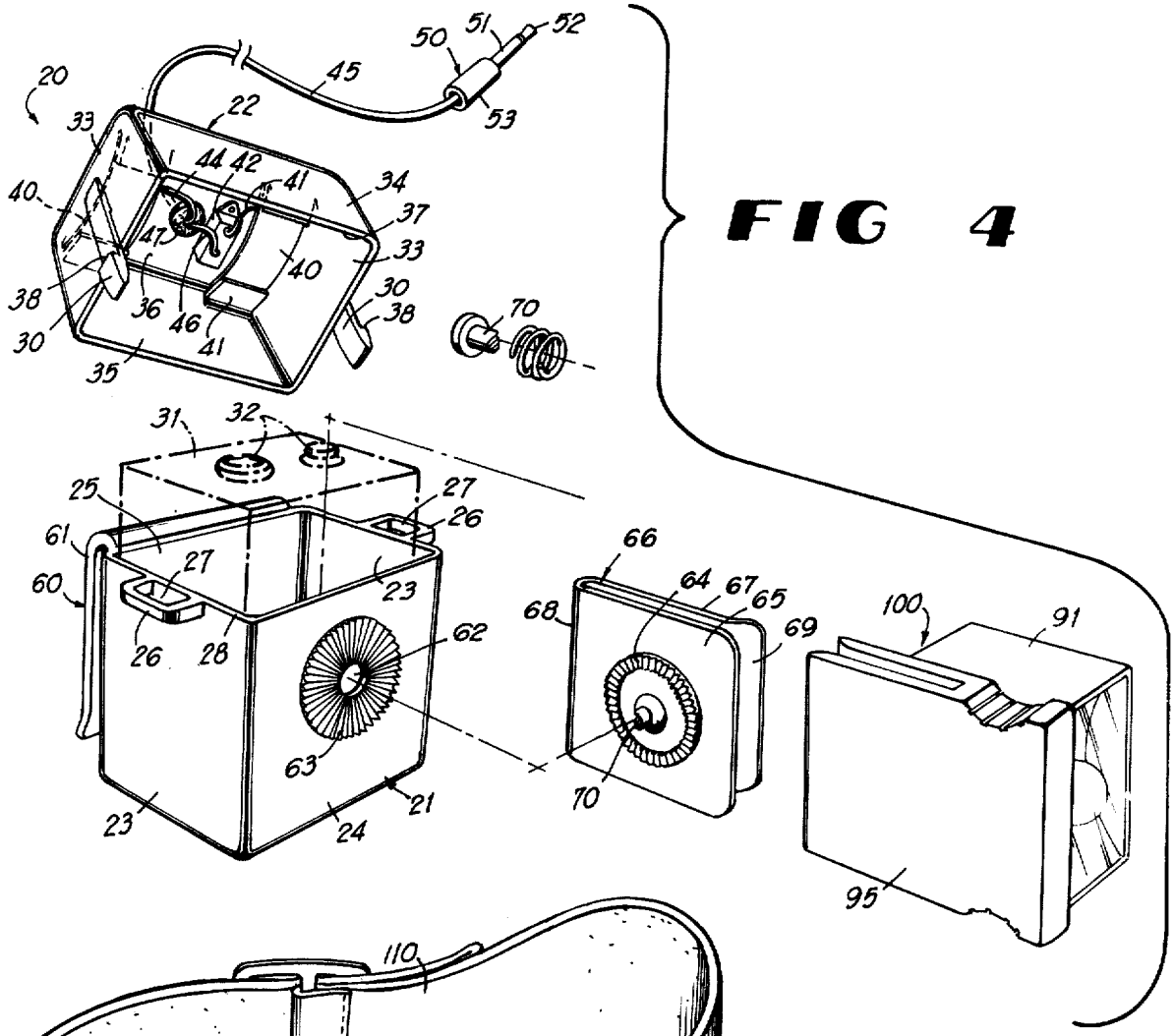
FIG. 4 is an exploded prospective view of the battery pack of the illuminating apparatus receiving the lamp element depicted in FIG. 2.

Referring now in detail to the embodiments chosen for the purposes of illustrating the present invention, numeral 10 in FIG. 1 denotes generally a person, such as a miner who is wearing a belt 11 and a hardhat 12. The hardhat 12 is of conventional construction and has a dome 13 provided with a visor 14. The visor is rigidly attached to the rim of the dome and protrudes forwardly therefrom. The hardhat 12 also includes the usual liner 15 which spaces the dome 13 away from the head of the miner 10.

In FIG. 1, the miner 10 is shown wearing the illuminating apparatus of the present invention, this apparatus including a battery pack comprising a battery carrying case or housing 20 formed of cooperating opposed cup-like housing shells 21 and 22. The lower housing shell 21 is a rectangular, cup-shaped, upwardly opening member having spaced, opposed, downwardly converging, side walls 23 which are slightly trapezoidal in shape, a front generally rectangular wall 24 and opposed rear rectangular walls 25. The shell 21 also includes a bottom (not shown) joining the lower end portions of the side walls 23, the front wall 24, and the back wall 25. The side walls 23 at their upper central portions are provided with opposed, outwardly protruding, generally rectangularly shaped, eyelets 26 which have central openings 27 with vertical axes and through which are removably received the downwardly protruding detent fingers 30 of the upper shell 22.

A dry cell battery 31 is illustrated in broken lines in FIG. 4 as being received in the interior of the lower shell 21, the upper end portion of this dry cell battery 31 protruding above the rim 28 of the shell 21 and is provided with the usual terminals 32.

The upper or top shell 22 is a downwardy opening rectangular cup-shaped member including a pair of opposed side walls 33, a front wall 34 and a back wall 35, the upper ends of which are joined by a top plate 36. The shell 22 has a lower rim 37 which is in a plane parallel to the top plate 36 and abutts the rim 28, when the top shell 22 is installed on the bottom shell and the detent members 30 protrude through the holes 27.

It will be observed that the detent members 30 are mounted on an integrally formed with side walls 33 and are tapered members which come generally to a wide point and are provided, rearwardly of these points, with locking shoulders 38. The shells 21 and 22 are injections moulded of plastic and, hence, the detent members 30 are sufficiently resilient that they normally will spring outwardly yieldably move inwardly as they are inserted into eyelets 26 and lock the shell 22 in place, as depicted in FIG. 1, with the shoulders 38 disposed below the eyelets 26. When the detent members 30 are depressed inwardly, the shoulders 38 will clear the eyelets 26 and permit the removal of the shell 22 from the shell 21.

Within the interior top portion of the shell 22 are a pair of spaced, opposed, electrically conducting, contact plates 40 which are appropriately mounted for contacting the electrodes 32, respectively. These contact plates 40 are flexed downwardly and are supported in appropriate recesses, such as recess 41, within the interior of the shell 22. One of the contact plates 40 is connected through a wire 41 to a single pole, single throw, on-off switch 42 mounted on the bottom surface of top plate 36 with its control button 43 protruding up through an appropriate hole in the top plate 36. The other electrode 40 is connected to a wire 44 which is one of the two wires of a flexible cable 45, the other wire 46 of which is connected to the switch 42. The cable 45 protrudes through an appropriate grommet 47 in the top plate 36 and is provided at its distal end with a male plug 50, one wire 44 being connected to the sleeve or shank 51 of plug 50 and the other wire 46 being connected to the tip 52 thereof. The plug 50 also contains an insulator sleeve 53 from which the shank 51 protrudes.

Referring back to the lower shell 21, it will be seen that there is a downwardly opening U-shaped clip 60 mounted on the rear wall 25 of the shell 21. This clip 60 has an outer plate 61 which, when the housing 20 is mounted on the body of miner 10, extends along the inner surface of the belt 11 whereby the belt 11 and clip 60 provides the sole support of the housing 20.

The front wall 24 is provided with a central hole 62 around which is provided annular rows of radially extending serrations 63 integrally formed with the wall 24. These serrations 63 cooperate with an annular group of serrations 64 fixed on the inner plate of a rotatable U-shaped clip 66, the clip 66 having an outer plate 67 joined along a common edge 68 to the plate 65 so as to provide an opening 69 therebetween. A removable bolt 70 which protrudes the hole 62 and through a helical spring 71, mounts the clip 66 to the front wall 24 and the cooperating serrations 63 and 64 yieldably permit rotation of clip 66.

As best seen in FIG. 2, there is provided a bulb carrying socket member 80 having an outer tubular insulating casing 81 which has at its outer end a knurled cap 82 and is provided along its central and inner portion with external threads 83. The forward end of tubular casing 81 carries a bulb socket or receptable 84 which protrudes axially therefrom. The socket or receptacle 84 removably receiving a bulb 85. Receptacle 84 is electrically connected to a plug socket or receptacle 86 which is coaxially mounted in and carried by the tubular casing 81. The socket or receptacle 86 opens rearwardly in a direction opposite to the direction of opening of the socket or receptacle 84 and is adapted to removably receive the tip 52 and the shank 51 of the plug 50. When the plug 50 is inserted into the socket 86 as shown in FIG. 1, an electrical circuit is completed to the bulb 85 from the cable 45. Therefore, when the switch 43 is closed, the bulb 85 will be lighted.

The tubular socket member 80 is threadedly received through a central forwardly or longitudinally extending bore 90 in the bulb housing 91 of a lamp element 100. When the socket member 80 is installed, the internal threads 82 defining the bore 90 will threadedly engage and receive the external threads 83. The extent of rotation of the socket 80 by manipulation of the head 82 will determine the axial positioning of the socket member 80 within the bulb housing 91, thereby determining the positioning of the bulb 85.

The forward portion of the bulb housing 91 is concaved to define an outwardly opening cavity communicating with bore 90 which receives a curvilinear concaved reflector 93. the bulb 85 protrudes through a central hole in the reflector 93 and hence, through manipulation of socket 80, the bulb 85 will be moved axially for being located at the focal point of reflector 93 as depicted in A of FIG. 3, or forwardly of the focal point as depicted in B of FIG. 3 or rearwardly of the focal point as depicted in C of FIG. 3. Thus, the lamp element 100 may be focused at infinity or at less than infinity or for difusion of the light.

The housing 91 is a moulded plastic rectangular or right prism block, the bottom surface of which is integrally joined to one plate of a bifurcated rearwardly opening clip 95, the clip 95 having a pair of plates or clip members 96 and 97 which are in spaced relationship to each other to define the rearwardly and laterally opening slot 98. The inner surfaces of the clip members 96 and 97 taper forwardly so that when the clip 95 is installed on visor 14 they spring outwardly as the tip portions of such surfaces engage the opposite surfaces of the visor providing progressively more surface to surface contact as the visor is wedged therebetween. The plane of slot 98 is parallel to and spaced below the axis of bore 90. The clip 95 is wider than the block 91 and, hence, there are provided opposed finger receiving recesses 99 on opposite sides of the clip 95 so that the clip 95 may be held between the thumb and forefinger when being inserted on the visor 14. Serrations in the form of spaced parallel vertical grooves 101 are provided in the recesses 99 as depicted in FIG. 2. Plates 96 and 97 being of plastic are sufficiently yieldable that their inner surfaces clamp the visor on opposite sides as shown in FIG. 1.

Figure 5:
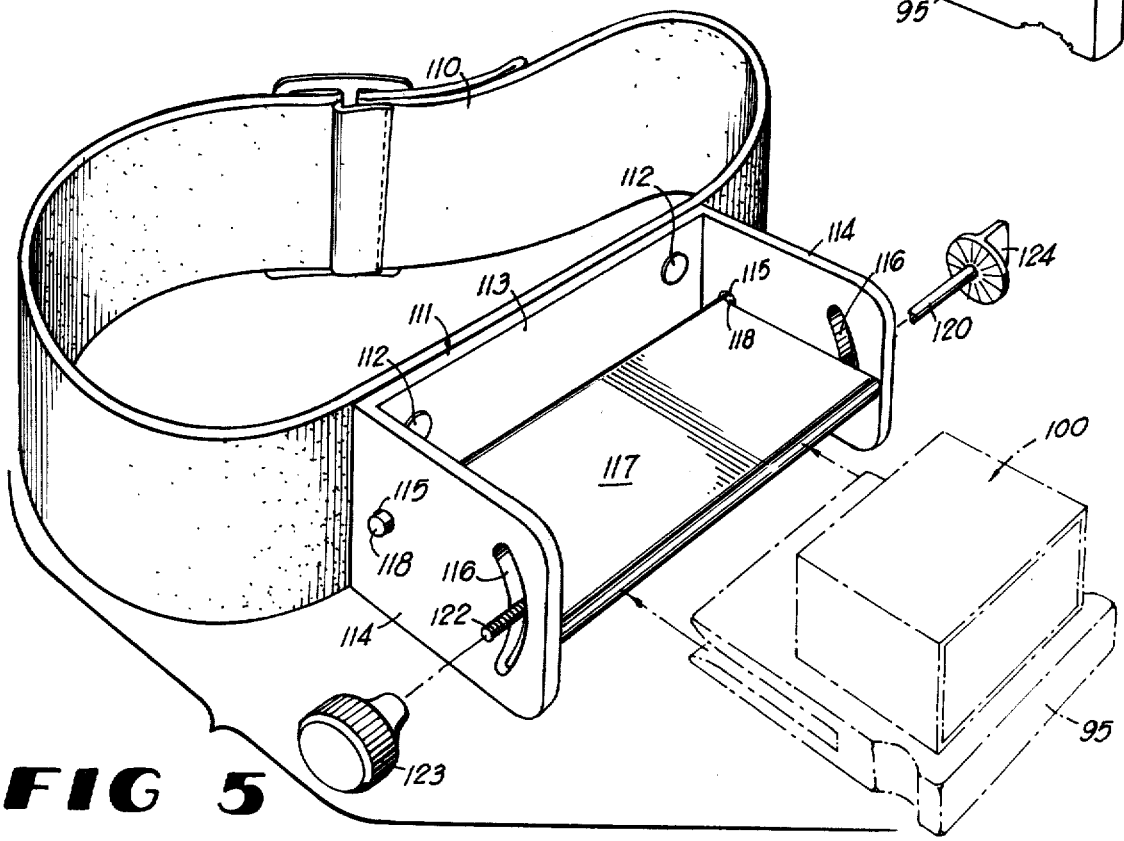
FIG. 5 is an exploded prospective view of an alternate embodiment of the present invention showing a headband assembly for removably carrying the illuminating element of FIG. 2.

In the alternate embodiment shown in FIG. 5, a flexible continuous, adjustable, elastomeric head band 110 is provided with a U-shaped bracket 111, the U-shaped bracket 111 being secured to the band 110 by means of brads 112 which protrude through the base 113 of the bracket 111. The bracket 111 has a pair of spaced, parallel, opposed, outwardly protruding, legs 114 the proximal ends of which are mounted on the ends of the base 113. Each of the legs 114 has a central hole 115 adjacent its proximal end and an arcuate closed slot 116 which is forwardly of the hole 115. The slot 116 arcs about the axis of the holes 115. A tiltable plate 117 is carried by the brackets 114, the plate having aligned trunions 118 at their inner corners which are received respectively in the holes 115. A rod 120 having at one end a head 121 and external threads 122 at the other end, protrudes through and outwardly of the openings 116 and through a hole in the plate 117. A removable knob 123 is threaded on the threads 122 so as to enable the clamping action between the head 121 and the knob 123 to lock the plate 117 in any prescribed angular position, as limited by the movement of the rod 117 within the slots 116.

The lamp element 100, depicted in broken lines in FIG. 5, is removably received by the plate 117 when the clip 95 is inserted on the plate 117. Thus, the head band assembly depicted in FIG. 5 can be substituted for the hardhat 12 and serves as an alternate means for carrying the lamp element 100.

From the foregoing description, it will be apparent that in use, the cable 45 can be threaded up through the space between the liner 15 and the dome 13 of the hardhat 12 and then the plug 50 inserted into the socket or receptacle 86. The clip 95 can then be installed on the visor or visor plate 14, as depicted in FIG. 1, and the housing 20 clipped onto the belt 11, as depicted in FIG. 1. Then, through manipulation of the switch 43, the bulb 85 may be cut on and off. Through rotation of the cap 82, the bulb 85 can be focused while the device is in use.

If the hardhat 12 is not required, the head band 110 can be employed and the lamp element 100 installed on the plate 117 as depicted in FIG. 5.

Still another manner of using the illuminating element 100 is to insert the clip 95 on plate 67 of clip 66 or on plate 61 of clip 60 so that the device may then be used as a conventional flash light, being held in a person's hand or, is the lamp element 100 is on plate 67, it can be clipped to the belt by means of clip 60 and the lamp element 100 rotated so as to aim it in an appropriate direction.

It will be obvious to those skilled in the art that many variations may be made in the embodiments here chosen for the purpose of illustrating the present invention without departing from the scope thereof as defined by the appended claims.

I claim:

1. An illuminating apparatus comprising:

(a) a battery pack;

(b) a cable electrically connected to and leading from said battery pack; and (c) a lamp element having a bulb housing, a bulb in said housing for electrically connecting to said cable, and a clip connected to said bulb housing, said clip having a pair of spaced opposed clip members with opposed friction surfaces defining a rearwardly opening slot, said clip members being yieldable with respect to each other for frictionally engaging opposite surfaces of a plate on which the illuminating member is to be mounted.

2. The illuminating apparatus defined in claim 1 wherein said clip and said bulb housing are integral, said bulb housing being mounted on the side of one of said clip members.

3. The apparatus defined in claim 2 wherein said clip is wider than said bulb housing and said clip is provided with a pair of opposed recesses for receiving the thumb and index finger of a person's hand when the person is inserting the clip on said plate and when a person is removing the clip from said plate.

4. The illuminating apparatus defined in claim 1 wherein said bulb housing is provided with an axial bore and including a bulb carrying member mounted in said bore and carrying said bulb.

5. The illuminating apparatus defined in claim 4 wherein said bulb carrying member is removable from said bore and is incrementally adjustable along the axis of said bore for altering the position of said bulb with respect to said bulb housing.

6. The illuminating apparatus defined in claim 5 wherein said bulb housing is provided with a recess communicating with said bore and including an arcuate reflector having a hole through which said bulb projects, received in said recess.

7. The illuminating apparatus defined in claim 4 wherein said bulb carrying member includes a pair of receptacles protruding from opposite ends of said bulb carrying member and being electrically connected together, one of said receptacles receiving and supporting said bulb, and a plug on the end of said cable, said plug being adapted to be removably received in the other of said receptacles.

8. The illuminating apparatus defined in claim 4 wherein said bulb carrying member has external threads and said bulb housing is provided with internal threads along said bore for receiving said external threads when said bulb carrying member is received in said bore.

9. The illuminating apparatus defined in claim 7 wherein said bulb carrying member includes a head of larger diameter than the diameter of the threaded portion of said bulb carrying member.

10. The illuminating apparatus defined in claim 7 wherein said bulb housing is recessed and including a reflector received in the recessed portion of said housing, said reflector having a hole through which said bulb projects, said reflector reflecting the rays of said bulb forwardly.

11. The illuminating apparatus defined in claim 4 wherein said bore extends forwardly and said slot is open rearwardly and on both sides.

12. The illuminating apparatus defined in claim 11 wherein said slot is disposed in a plaen and said bore has an axis which is disposed generally parallel to and spaced from and on one side of the plane of said slot.

13. The illuminating apparatus defined in claim 1 wherein said battery pack includes a rotatable plate for receiving and frictionally holding the clip members of said clip.

14. The illuminating apparatus defined in claim 1 wherein said battery pack includes a battery housing having a hollow interior for receiving a battery, a clip on one side of said battery housing for selectively being utilized to be inserted on the belt of a person for supporting said battery housing or for receiving one of said clip members.

15. The illuminating apparatus defined in claim 1 wherein said battery pack includes a battery housing for removably housing a battery, a belt clip mounted on one side of said housing for mounting on a belt to support said housing on said belt, a plate disposed on the outer side of said housing opposite to said belt clip for removably receiving said clip of said illuminating member.

16. The illuminating apparatus defined in claim 15 including annular serrations on said battery housing and annular serrations on said plate and means for rotatably supporting said plate for rotation with respect to said battery housing.

17. The illuminating apparatus defined in claim 1 including a clip receiving plate, mounting means for mounting said plate to the body of a person, said plate removably receiving the frictional surfaces of said clip members.

18. The illuminating apparatus defined in claim 17 wherein said mounting means includes a head band, a bracket mounted on said head band and wherein said clip receiving plate is pivotally carried by said head band.

19. The illuminating apparatus defined in claim 18 including locking means for locking said plate in various pivoted positions.

20. The illuminating apparatus defined in claim 18 wherein said bracket includes a pair of opposed legs extending forwardly from said head band, trunions on said plate pivotally journalled by said legs for pivotally supporting said plate therebetween and means for locking said plate in various angular positions with respect to said legs.

* * * * *